US009774082B2

(12) United States Patent
Piazza et al.

(10) Patent No.: US 9,774,082 B2
(45) Date of Patent: Sep. 26, 2017

(54) RECONFIGURABLE ANTENNA STRUCTURE

(71) Applicant: Adant Technologies, Inc., Santa Clara, CA (US)

(72) Inventors: Daniele Piazza, Padua (IT); Mauro Facco, Padua (IT)

(73) Assignee: ADANT TECHNOLOGIES, INC., Santa Clara, CA (US)

( * ) Notice: Subject to any disclaimer, the term of this patent is extended or adjusted under 35 U.S.C. 154(b) by 357 days.

(21) Appl. No.: 14/371,581

(22) PCT Filed: Jan. 9, 2013

(86) PCT No.: PCT/EP2013/050281
§ 371 (c)(1),
(2) Date: Jul. 10, 2014

(87) PCT Pub. No.: WO2013/104656
PCT Pub. Date: Jul. 18, 2013

(65) Prior Publication Data

US 2014/0368392 A1 Dec. 18, 2014

(30) Foreign Application Priority Data

Jan. 11, 2012 (IT) ..... TV2012A0002

(51) Int. Cl.
*H01Q 3/24* (2006.01)
*H01Q 3/44* (2006.01)
(Continued)

(52) U.S. Cl.
CPC ..... *H01Q 3/247* (2013.01); *H01Q 3/446* (2013.01); *H01Q 19/005* (2013.01); *H01Q 9/0407* (2013.01)

(58) Field of Classification Search
CPC ..... H01Q 3/247; H01Q 3/446; H01Q 19/005; H01Q 9/0407
(Continued)

(56) References Cited

U.S. PATENT DOCUMENTS

2007/0229357 A1 10/2007 Zhang et al.
2010/0141517 A1* 6/2010 Surittikul ..... H01Q 3/446 342/357.64
2011/0080325 A1 4/2011 Livneh et al.

FOREIGN PATENT DOCUMENTS

EP 1962375 A1 8/2008
EP 2048739 A1 4/2009
(Continued)

*Primary Examiner* — Dameon E Levi
*Assistant Examiner* — David Lotter
(74) *Attorney, Agent, or Firm* — Polsinelli PC

(57) ABSTRACT

The present invention refers to a reconfigurable antenna structure. The antenna structure comprises a radiating structure comprising one or more first radiating elements and a secondary radiating structure, operationally associated with said primary radiating structure. Said secondary radiating structure comprises a plurality of second radiating elements that can be selectively electrically connected/disconnected to each other to vary the configuration of said secondary radiating structure, so as to vary the radiating properties of the antenna structure. The antenna structure also comprises first reactive loads, electrically connected between said primary and secondary radiating structures, and second reactive loads, electrically connected to said secondary radiating structure. Said first reactive loads, said second reactive loads and said second radiating elements forming one or more circuitry structures that are electrically resonant in the operating frequency band of said antenna structure and that are electrically connected/disconnected to each other in a selective manner in accordance to the configuration selected for said second radiating structure, thereby
(Continued)

maintaining constantly equal to zero the overall reactive load that is electrically connected to said primary radiating structure.

20 Claims, 9 Drawing Sheets

(51) Int. Cl.
*H01Q 19/00* (2006.01)
*H01Q 9/04* (2006.01)

(58) Field of Classification Search
USPC ..... 343/750
See application file for complete search history.

(56) References Cited

FOREIGN PATENT DOCUMENTS

| | | | |
|---|---|---|---|
| WO | WO-2008/054803 A2 | | 5/2008 |
| WO | WO 2008/103102 | * | 8/2008 |

* cited by examiner

RECONFIGURABLE ANTENNA STRUCTURE

CROSS REFERENCE TO RELATED APPLICATIONS

This application is a National Phase filing under 35 U.S.C. §371 of PCT/EP2013/050281 filed in Jan. 9, 2013; and this application claims priority to Application No. TV2012A000002 filed in Italy on Jan. 11, 2012 under 35 U.S.C. §119; the entire contents of all are hereby incorporated by reference.

The present invention refers to the field of adaptive antennas for the reception and/or transmission of radio frequency signals.

In particular, the present invention refers to a reconfigurable antenna structure.

The use of adaptive antenna systems is very widespread.

As is known, an adaptive antenna system is generally capable of dynamically altering its radiation characteristics in response to a variation in the characteristics of the channel for receiving and/or transmitting electromagnetic waves.

The characteristics of the reception and/or transmission channel, in turn, depend on the type of device connected to the adaptive antenna system by means of the communication channel itself.

A known type of adaptive antenna systems is represented by reconfigurable antenna structures.

These devices are able to change the orientation of the radiation pattern lobes and/or the polarization of the radiated electromagnetic field, by appropriately varying the spatial distribution of the antenna current flowing on the antenna structure.

Traditionally, a reconfigurable antenna structure comprises an active radiating element, electrically connected to a radio frequency source and/or receiving device.

Some known reconfigurable antenna structures are also provided with one or more passive radiating elements, operationally associated with said active radiating element.

By varying the mutual electric coupling between the active radiating element and the passive radiating elements, it is possible to vary the current distribution in the antenna structure and therefore change the direction of the radiation lobes and/or the polarization of the radiated electromagnetic field.

For example, delays or advances in the phase of the antenna current induced on the passive radiating elements can make them act as directors or reflectors of the electromagnetic radiation received and/or transmitted by the active radiating element.

Reconfigurable antenna structures currently available have several drawbacks.

In many cases, in particular when the antenna size is much smaller than the wavelength corresponding to the operating frequency, these antennas can reconfigure the radiation diagram to a limited extent, in a relatively small number of directions.

It has also been noted that traditional reconfigurable antenna structures exhibit significant variations in input impedance when varying their radiating characteristics. This may cause poor power transfer from/to the antenna and therefore significant degradation of the overall system performance.

Lastly, in cases where a high degree of re-configurability of the radiating properties is requested, current reconfigurable antenna systems are characterized by very high production costs, in many cases making them economically disadvantageous to use.

In general, the aforesaid drawbacks make it very difficult to integrate currently available reconfigurable antenna structures into electronic devices that are relatively small in size, such as, for example, portable computerized devices, mobile telephony devices or similar.

Therefore, the main aim of the present invention is to provide a reconfigurable antenna structure that allows to overcome the aforesaid drawbacks.

In the context of this aim, an object of the present invention is to provide an antenna structure that can offer high performance in terms of the re-configurability of its radiating characteristics.

A further object of the present invention is to provide an antenna structure that can ensure excellent impedance adaptation to the reception and/or transmission channel, as its radiating characteristics vary.

Yet another object of the present invention is to provide an antenna structure that is easy to produce industrially, with relatively low costs, including the case where the overall dimensions are significantly smaller than the operating wavelengths.

This aim and these objects, as well as other objects that will be apparent from the description below and from the accompanying drawings, are achieved, according to the invention, with an antenna structure according to claim 1, proposed below.

As part of a general definition, the antenna structure according to the invention comprises a primary radiating structure comprising one or more first radiating elements.

Advantageously, the aforesaid primary radiating structure is electrically connected to an electronic receiving device and/or an electronic transmitting device.

The antenna structure according to the invention comprises a secondary radiating structure, operationally associated with said primary radiating structure.

The aforesaid secondary radiating structure comprises a plurality of second radiating elements that can be selectively electrically connected/disconnected to each other so as to vary the configuration of said secondary radiating structure, particularly the distribution of the current flowing in said secondary radiating structure and, consequently, its radiating properties.

The antenna structure according to the invention comprises first reactive loads, electrically connected between said primary and secondary radiating structures, preferably between said first and second radiating elements.

The antenna structure according to the invention also comprises second reactive loads, which are of a type different from said first reactive loads and which are electrically connected to said secondary radiating structure, preferably to said second radiating elements.

According to the invention, said first reactive loads, said second reactive loads and said second radiating elements form a plurality of circuitry structures that are electrically resonant in the operating bandwidth of the antenna structure, thereby maintaining constantly equal to zero the overall reactive load that is electrically connected to said primary radiating structure.

Thanks to said resonant circuitry structures, each of which is advantageously formed by a first reactive load, a second radiating element and a second reactive load, the overall impedance offered by said antenna structure is kept substantially constant as the configuration of said secondary radiating structure varies, particularly as the distribution of the current flowing in said secondary radiating structure varies, and consequently, as the radiating properties of the antenna structure itself change.

Preferably, said first and second radiating elements consist of electrically conducting structures, advantageously operationally associated to a support made of insulating material.

Preferably, the antenna structure according to the invention comprises first circuitry elements to selectively electrically connect/disconnect said second radiating elements to each other so as to dynamically vary the configuration of said secondary radiating structure, particularly the distribution of the current flowing in said secondary radiating structure.

Preferably, said first circuitry elements comprise one or more switching devices and/or variable impedance inductors and/or variable impedance capacitors, electrically connected between said second radiating elements.

Preferably, said first reactive loads are of a capacitive type while said second reactive loads are of an inductive type.

Preferably, said second radiating elements have an electrical length much smaller than the characteristic operating wavelengths of said antenna structure.

Preferably, the antenna structure according to the invention has a substantially planar geometry.

Preferably, said first radiating elements and/or said second radiating elements are arranged along a first closed paths and/or a second closed path respectively.

Preferably, both the first and second radiating elements are devices arranged respectively along a first and second closed path that are substantially coplanar, said second closed path at least partially surrounding said first closed path.

Preferably, the first and second radiating elements consist of first and second conducting tracks that are substantially coplanar and deposited on a first surface of a supporting substrate.

Preferably, when they are of an inductive type, said second reactive loads consist of third conductive tracks, deposited on a second surface of said supporting substrate.

Further characteristics and advantages of the present invention will be more apparent with reference to the description given below and to the accompanying figures, provided purely for explanatory and non-limiting purposes, wherein.

Figure 1:
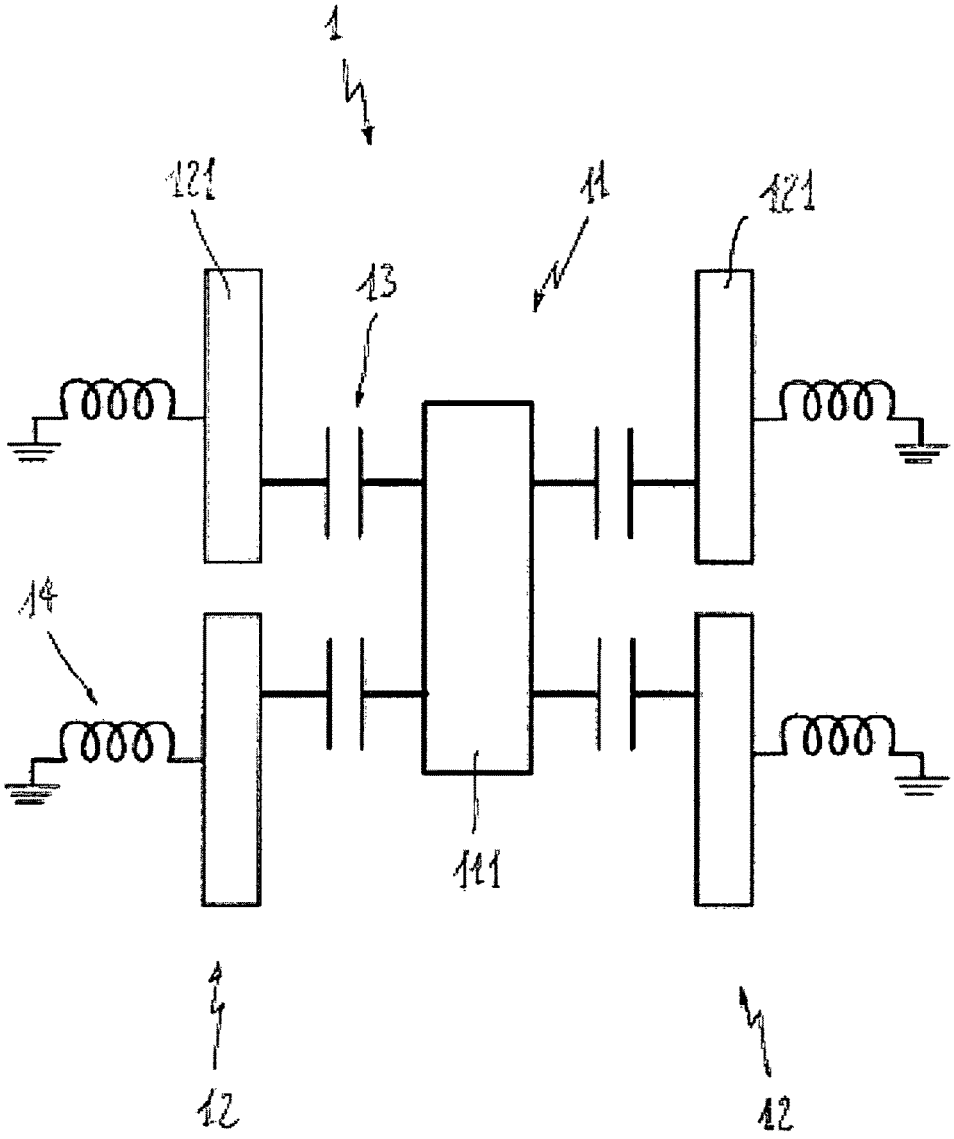
FIG. 1 shows a schematic view of the antenna structure according to the present invention, in a first embodiment.

With reference to the aforementioned figures, the present invention relates to a reconfigurable antenna structure 1.

The antenna structure 1 comprises a primary radiating structure 11 to receive and/or transmit electromagnetic radiation in radio frequency.

The term electromagnetic radiation in radio frequency, in the context of the present invention, refers to an electromagnetic radiation with a carrier frequency of between 1 Hz and 300 GHz, preferably between 300 MHz and 70 GHz.

The radiating structure 11 is an active radiating structure, being advantageously electrically connected to an electronic receiving device and/or an electronic transmitting device (not shown).

When the antenna structure 1 receives an electromagnetic radiation from the surrounding space, the radiating structure 11 transmits a reception signal to the electronic receiving device which processes the signal, as required, for example by means of demodulation or decryption of the signal.

When the antenna structure 1 transmits an electromagnetic radiation into the surrounding space, the radiating structure 11 receives an antenna current from the electronic transmitting device (for example a radio frequency source), which results in the emission of electromagnetic radiation by the radiating structure.

The radiating structure 11 comprises one or more radiating elements 111.

In certain embodiments (FIG. 1), the radiating structure 11 comprises a single radiating element 111.

Figure 2:
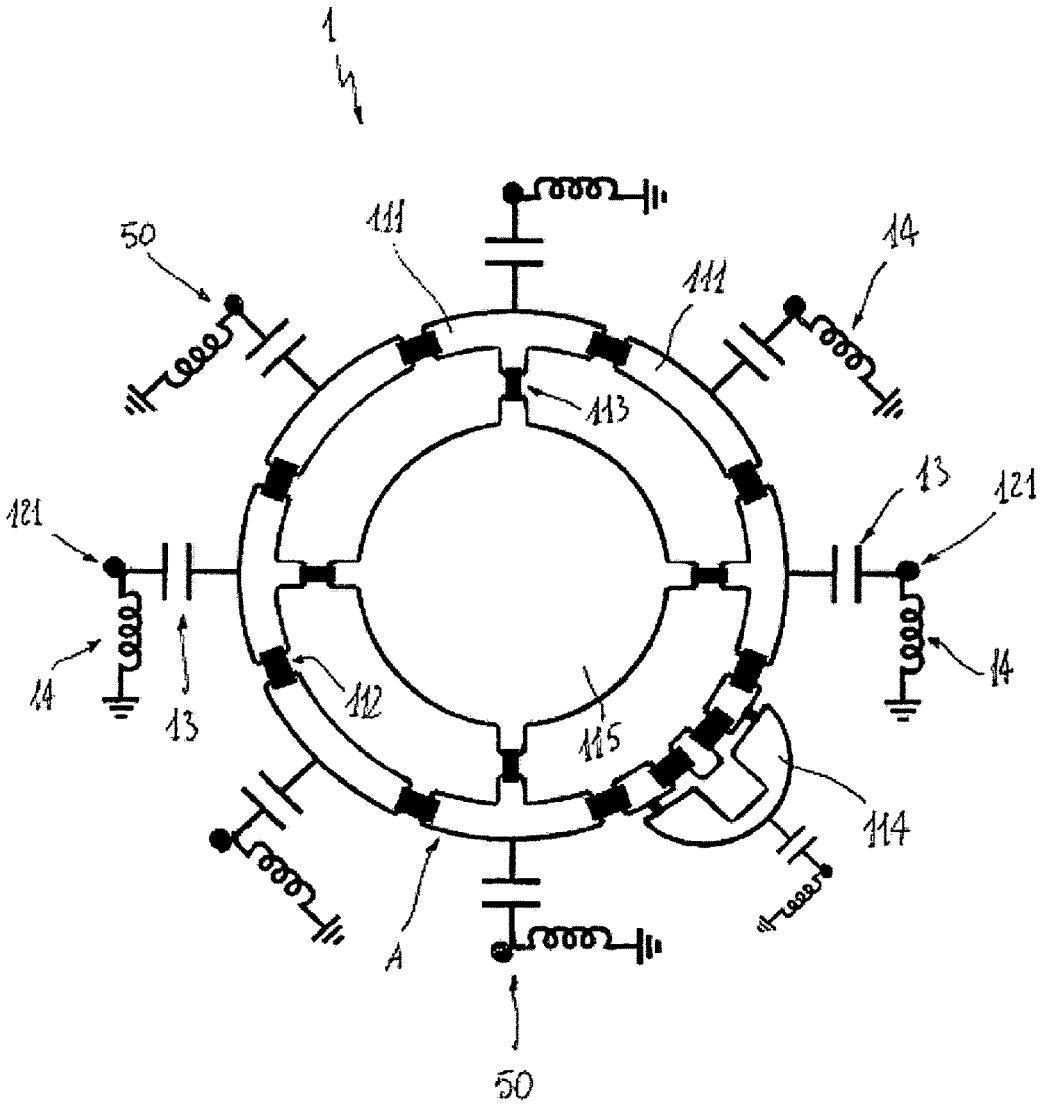
FIGS. 2-4 show schematic views of the antenna structure according to the present invention, in a further embodiment.
Figure 3:
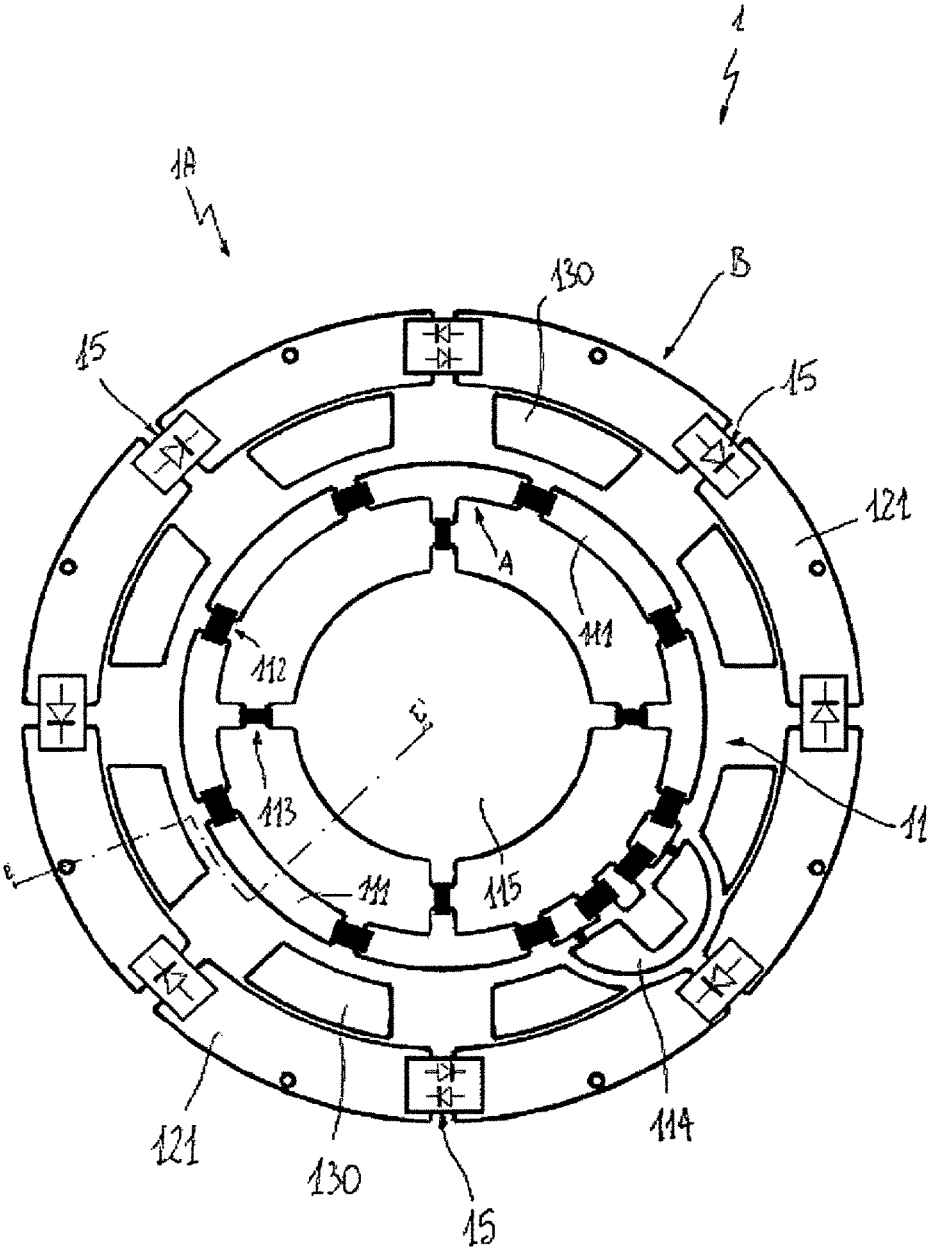
Figure 4:
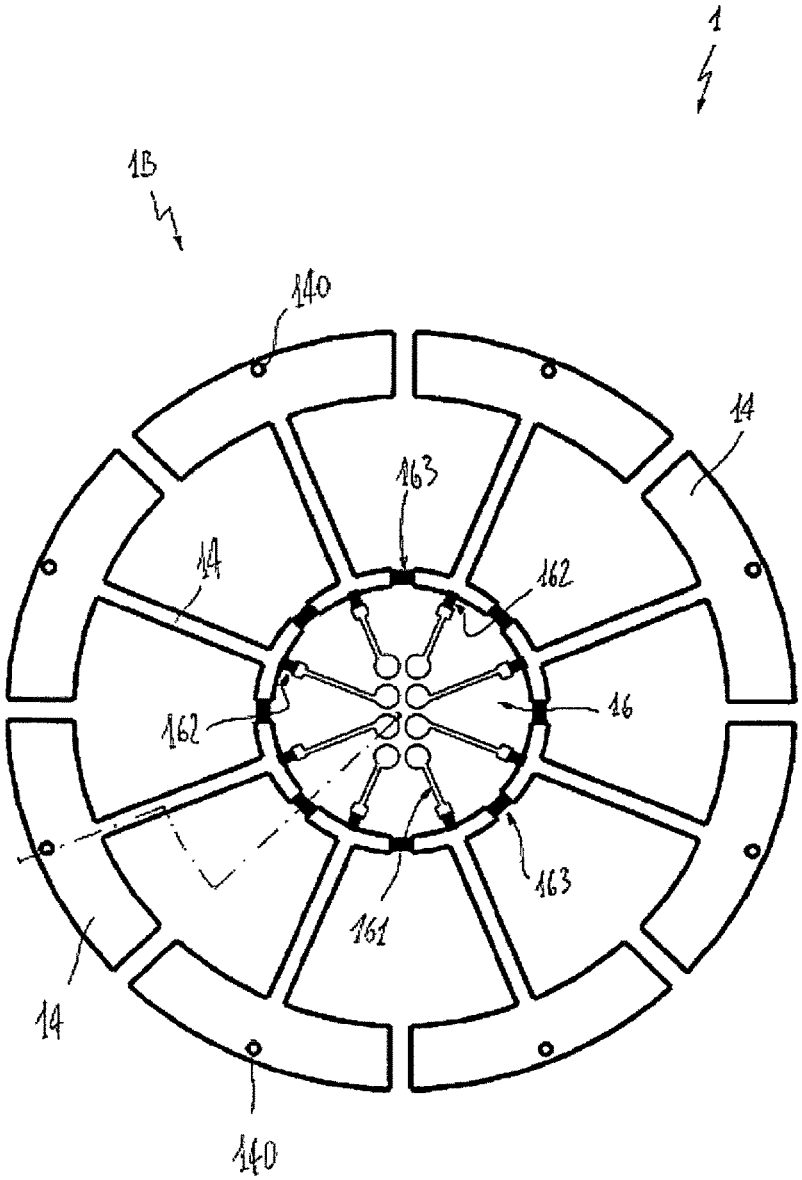

Preferably, as shown in FIGS. 2-4, the radiating structure 11 comprises several radiating elements 111 that are electrically connected to each other so as to form a single radiating body.

The antenna structure 1 comprises a secondary radiating structure 12, operationally associated with the primary radiating structure 11.

As will be better seen below, the radiating structure 12 can reflect and/or direct, at least partially, the electromagnetic radiation received and/or transmitted by the latter.

The secondary structure 12 is a passive radiating structure, since it is not electrically connected directly to an electronic receiving device and/or an electronic power device.

The secondary structure 12 comprises a plurality of second radiating elements 121 that can be selectively electrically connected/disconnected to each other to vary the configuration of the secondary radiating structure 12.

For the sake of clarity, two radiating elements 121 are considered electrically connected when they behave like a single radiating body, for example when a common antenna current flows through them (typically induced by the primary radiating structure).

Conversely, two radiating elements 121 are considered electrically disconnected when they behave like distinct radiating bodies, for example because no antenna current can flow between them.

Again for the sake of clarity, the radiating structure 12 is considered to vary its configuration when there is a variation in the spatial distribution of the antenna current flowing in it.

A variation in the configuration of the radiating structure 12 obviously results in a variation in the radiating properties of the antenna structure 1, particularly the radiation diagram and/or the polarization of the radiated electromagnetic field.

The antenna structure 1 comprises one or more first reactive loads 13, electrically connected (preferably in series) to the radiating structures 11, 12, advantageously between the radiating elements 111, 121.

The reactive loads 13 are advantageously adapted to induce or favour the flow of an antenna current in the secondary radiating structure 12, particularly in the radiating elements 121.

The antenna structure 1 also comprises one or more second reactive loads 14 electrically connected (preferably in parallel) to the radiating structure 12, advantageously to the radiating elements 121.

The reactive loads 14 are advantageously of a different type from the reactive loads 13.

Thus, if the reactive loads 13 are of a capacitive type, the reactive loads 14 are of an inductive type, and vice-versa.

Preferably, as shown in the aforementioned figures, the radiating elements 111, 121 consist of electrically conducting structures, operationally associated with a support made of insulating material.

In this case, as shown in the aforementioned figures, the reactive loads 13 are advantageously of a capacitive type while the reactive loads 14 are of an inductive type.

Preferably, the reactive loads 13 consist of parasitic connection capacities present between the radiating elements 111, 121.

Advantageously, the value of these parasitic connection capacities can be determined by appropriately varying the mutual distance between the radiating elements 111, 121, as a function of the desired intensity of the antenna current that one wants to flow, by induction, in the radiating structure 12.

The value of these parasitic connection capacities can also be determined by providing appropriate conducting structures 130, operationally associated with the secondary radiating elements 121 and positioned in the space separating the radiating elements 111, 121.

In alternative embodiments of the present invention (not shown), the reactive loads 13 can also comprise one or more capacitors/inductors (discrete devices), electrically connected between the radiating elements 111 and the radiating elements 121 (or the conducting structures 130).

Preferably, the reactive loads 14 consist of inductors (discrete or distributed devices) with one terminal electrically connected to the radiating elements 121 and a terminal that can be electrically connected, depending on the construction needs of the radiating structure 12, to a circuitry node of the antenna structure 1, to a common reference potential (e.g. earth), as shown in the aforementioned figures, or left floating.

As will be seen better below, the value of the reactive loads 14 is advantageously selected as a function of the value of the reactive loads 13 and of the operating bandwidth of the antenna structure 1.

Preferably, the antenna structure 1 comprises one or more first circuitry elements 15 to selectively electrically connect/disconnect the radiating elements 121 to each other so as to dynamically vary the configuration of the secondary radiating structure 12.

In particular, the circuitry elements 15 electrically connect/separate the radiating elements 121 so as to permit/prevent a common antenna current to flow between them.

The circuitry elements 15 are advantageously able to vary the equivalent electrical length of the radiating elements 121 of the radiating structure 12 and thereby to change the configuration of this structure, by varying the radiation diagram of the antenna structure 1 and/or the polarization of the radiated electromagnetic field.

Preferably, the circuitry elements 15 comprise one or more switching devices, for example discrete or integrated transistors, electrically connected between the radiating elements 121, so as to be able to permit/prevent an antenna current flowing between them.

Preferably, the antenna structure 1 is operationally associated with a control device (not shown) to generate appropriate command signals to enable/disable the switching devices 15 (by switching them to a conducting/non-conducting state) and therefore to be able to dynamically vary the configuration of the antenna structure 12.

Embodiments of the present invention may be provided with the aforementioned command device integrated with the antenna structure 1.

Preferably, the antenna structure 1 comprises a driving circuit 16 comprising one or more bias lines 161 to power the circuitry elements 15 (FIG. 4).

Preferably, the driving circuit 16 comprises second circuitry elements 163, of a capacitive type, to electrically disconnect the bias lines 161 from each other.

Preferably, the driving circuit 16 also comprises third circuitry elements 162, of an inductive type, to disconnect the bias lines 161 from the radiating elements 121.

In principle, any configuration of the radiating structure 11 is possible, depending on needs.

The number of configurations and arrangements of the radiating elements 111 can be advantageously determined as a function of the desired impedance value for the radiating structure 11, which in turn depends on the characteristic operating frequency band of the antenna structure 1.

As shown in FIG. 1, the radiating structure 11 may comprise a single radiating element 111, for example formed from a single conducting structure.

Possible embodiments of the present invention (not shown), may have a single radiating element consisting of a ring or conducting track running along a closed path.

Preferably, as shown in FIG. 2, the radiating structure 11 comprises a plurality of radiating elements 111 electrically connected to each other by means of fourth connecting circuitry elements 112 of a capacitive type, so as to form a single radiating body.

The radiating elements 111 may be electrically connected, by means of fifth connecting circuitry elements 113 of an inductive type, to further conducting structures 115, which may be variously arranged and configured as a function of the chosen impedance value for the radiating structure 11.

The radiating structure 11 may also advantageously comprise a so-called "Balun network" 114 or an equivalent circuitry structure for electrically connecting the set of radiating elements 111 (which constitute a balanced electrical line) to the (unbalanced) electrical line for connecting the aforementioned electronic receiving device and/or electronic transmitting device.

Preferably, the radiating elements 121 have an electrical length significantly smaller than that of the antenna structure 1.

For example, the radiating elements 121 have an electrical length less than $\lambda/10$, where $\lambda$ is the average wavelength over the operating frequency band of the antenna structure 1.

The number of radiating elements 121 can be advantageously selected on the basis of the number and type of directional radiating modes chosen to reconfigure the radiation diagram of the antenna structure 1.

Preferably, as shown in the aforementioned figures, the radiating elements 111, 121 are arranged respectively along a first and second closed path A, B that are substantially coplanar, and arranged so that the second closed path B at least partially surrounds the first closed path A.

Preferably, for obvious reasons of symmetry, the closed paths A, B are circular. They may also have different forms, depending on needs.

In embodiments in which the antenna structure 1 has a single radiating element 111, the radiating elements 121 could still be arranged along a closed path at least partially surrounding the single radiating element 111.

Preferably, the antenna structure 1 has a planar overall geometry.

Figure 5:
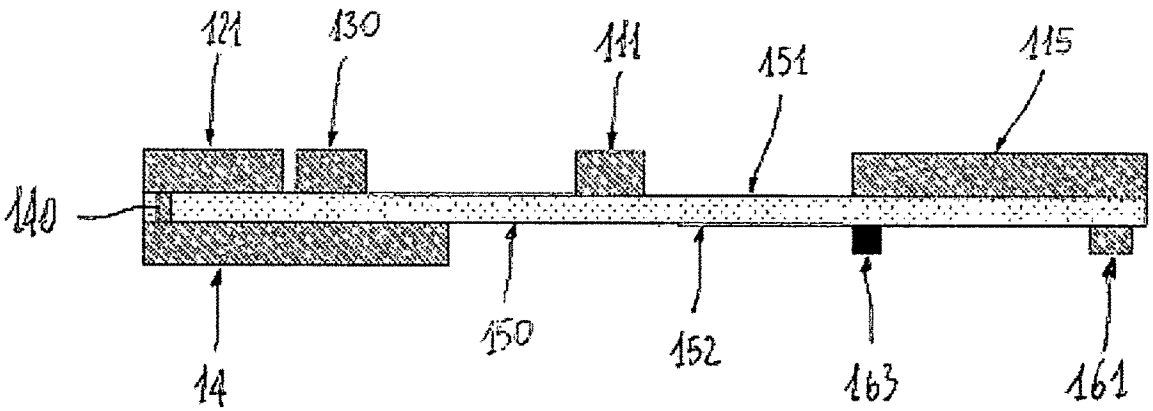
FIG. 5 shows a partial cross-section schematic view (cross section EE') of the antenna structure according to the present invention, in the embodiment shown in FIGS. 2-4.

In this case, as shown in FIGS. 2-5, the radiating elements 111, 121 may consist, respectively, of first and second conducting tracks, deposited on a first surface 151 of a supporting substrate 150, for example a support for printed circuits (FIG. 5, cross section EE').

The inductive reactive loads 14 may consist of third conducting tracks deposited on a second surface 152 of the supporting substrate 150, opposite surface 151.

The reactive loads 14 may be electrically connected to the radiating elements 121 by means of appropriate connections ("via holes") passing through the thickness of the substrate 150.

The circuitry or conducting structures 114, 115, 130, 161 may consist, respectively, of third, fourth, fifth and sixth conducting tracks, deposited on the surfaces 151 or 152 of the supporting substrate 150.

The circuitry elements 15, 112, 113, 162, 163 may consist, for example, of SMD (Surface Mounted Devices) type electronic components mounted on the surfaces 151, 152 of the supporting substrate 150.

With reference to the embodiment shown in FIGS. 2-5, operation of the antenna structure 1 will now be described in greater detail.

The antenna structure 1 is capable of selectively varying its radiating characteristics, for example the characteristics of its radiation diagram.

When the switching elements 15 are all in the non-conducting state (OFF), there is no common antenna current flowing between several radiating elements 121, which therefore are all electrically disconnected from each other.

The antenna current flowing in each radiating element 121 is the current induced by the capacitive connection (reactive load 14) with the radiating structure 11.

In this case, given that, preferably, the radiating elements 121 have a length much smaller than the operating wavelengths, the antenna structure 1 has a radiation diagram that substantially overlaps the characteristic radiation diagram for the primary radiating structure 11.

Figure 6:
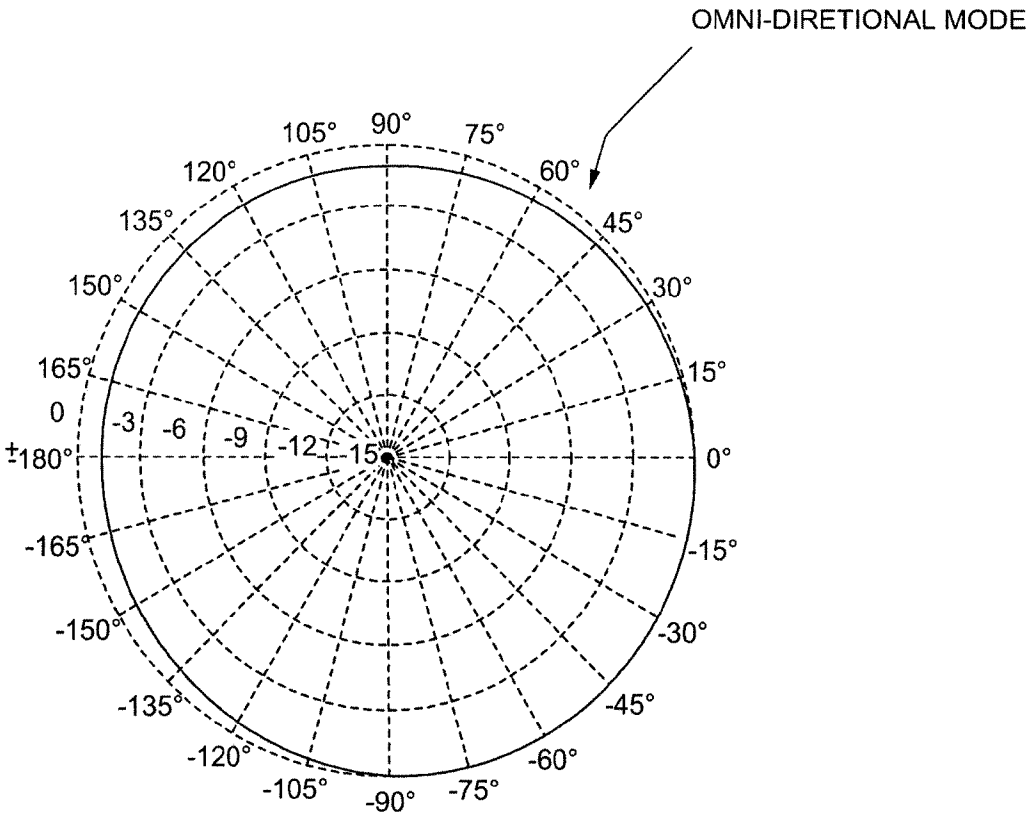
FIGS. 6-9 show a series of graphs relating to the operation of an antenna structure according to the present invention, in the embodiment shown in FIGS. 2-5.

Since the radiating structure 11 is designed to emit omni-directional radiation with respect to a support plane for the radiating elements 111, 121, the radiation diagram for the antenna structure 1 is substantially omni-directional, as can be seen from FIG. 6.

With all the switching elements 15 de-activated (OFF), the antenna structure 1 therefore operates in an omni-directional manner.

When one or more switching elements are switched to the conducting state (ON), two or more radiating elements 121 are electrically connected to each other.

A variation is thereby induced in the distribution of the antenna current flowing in the radiating structures 11, 12.

If the equivalent electrical length of the radiating elements 121 electrically connected to each other is slightly greater than the typical operating wavelengths, the group formed by the connected radiating elements 121 acts as a reflector and directs the electromagnetic radiation in a direction opposite to that in which it is positioned in relation to the radiating structure 11.

If the equivalent electrical length of the radiating elements 121 electrically connected to each other is slightly smaller than the typical operating wavelengths, the group formed by the connected radiating elements 121 acts as a director and directs the electromagnetic radiation in the same direction as that in which it is positioned in relation to the radiating structure 11.

Therefore, by selectively electrically connecting the radiating elements 121, it is possible to vary the radiation diagram of the antenna structure 1, as required.

Note that separate groups of radiating elements 121 electrically connected to each other could be simultaneously selectively activated, so as to act as directors or reflectors of the electromagnetic radiation, as required.

Figure 7:
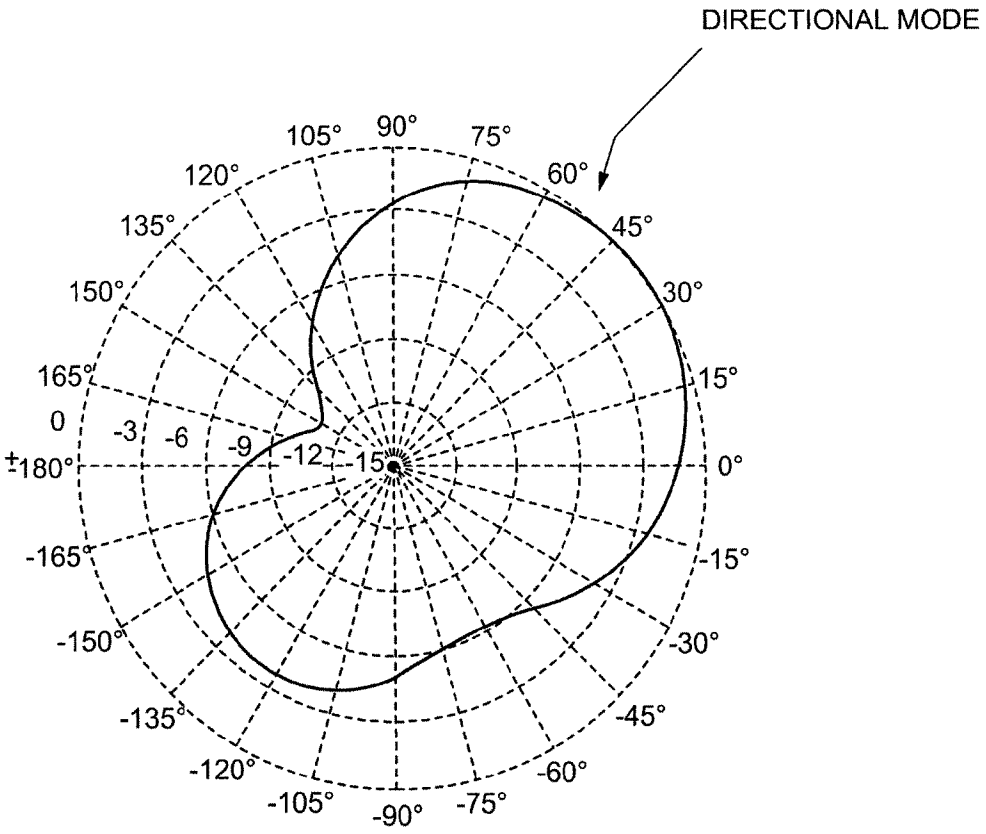
Figure 8:
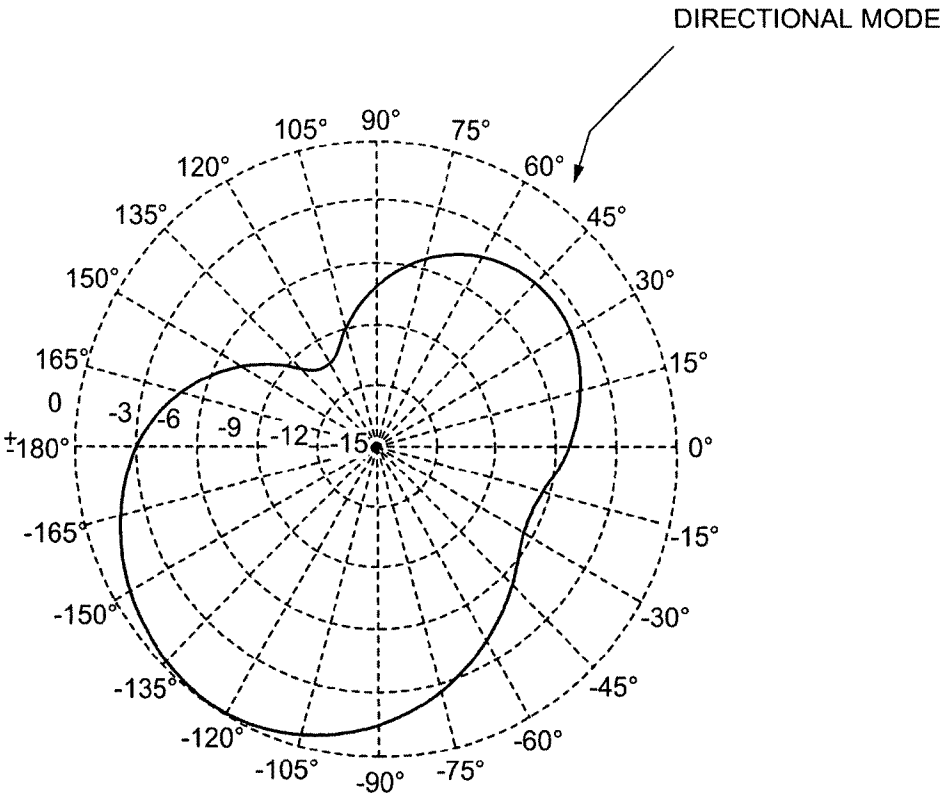

The antenna structure 1 can therefore operate directionally, as shown in FIGS. 6-7, with a highly anisotropic spatial disposition of the radiation lobes.

The radiation diagram for the antenna structure 1 can therefore be reconfigured so as to differ considerably from the characteristic radiation diagram for the radiating structure 11.

As shown in FIGS. 6-7, by acting appropriately on the switching devices 15, and selectively electrically connecting/disconnecting the second radiating elements 121, it is possible to have the antenna structure 1 operate in multiple directional modes.

The number of directional modes with which it is possible to reconfigure the radiation diagram depends substantially on the number of radiating elements 121 on the radiating structure 12.

The antenna structure 1 can therefore offer excellent performance in terms of its ability to reconfigure its radiating characteristic, as required.

Despite this marked capacity for reconfiguration, the antenna structure 1 is characterized in that it is able to maintain its impedance substantially constant as its radiating characteristics vary.

According to the invention, in fact, the first reactive loads 13, the second reactive loads 14 and the radiating elements 121 form one or more circuitry structures 50 that are electrically resonant in the operating frequency band of the antenna structure 1 and that are electrically connected/disconnected to each other by the switching elements 15, when these latter electrically connect/disconnect the radiating elements 121 one to another.

Since they are electrically resonant and they are electrically connected/disconnected to each other in a selective manner in accordance to the configuration selected for the radiating structure 12, the circuitry structures 50 constantly offer a null reactive load and are thus capable of maintaining constantly equal to zero the overall reactive load that is electrically connected to the primary radiating structure 11.

Therefore, the circuitry structures 50 are adapted to keep the impedance (when receiving and/or transmitting the electromagnetic radiation) of the antenna structure 1 substantially constant as the configuration of the secondary radiating structure 12 varies.

Each of the circuitry structures 50 is advantageously formed by a first reactive load 13, a radiating element 121 and a second reactive load 14.

Since the loads 13, 14 are of different types, for example capacitive and inductive respectively, each circuitry structure 50 can be advantageously arranged so as to be electrically resonant in the operating bandwidth of the antenna structure 1.

This can be achieved by selecting the appropriate value of the reactive loads 14, as a function of the value of the reactive loads 13, this value substantially depending on the configuration and mutual position of the radiating elements 111, 112 (and therefore, substantially, on the overall dimensions of the antenna structure 1).

The following relationships apply:

$$\omega = \frac{1}{\sqrt{L_p C_s}} \rightarrow L_p = \frac{1}{\omega^2 C_s}$$

where $f=2\pi/\omega$ is the operating frequency of the antenna structure 1, Cs is the value of the reactive loads 13, and Lp is the value of the reactive loads 14.

Being in a condition of resonance, the reactive load of each circuitry structure 50 is substantially zero.

Each radiating element 121, considered independently and electrically disconnected from the other radiating elements 121, does not cause any variation in the reactive load applied to the primary radiating structure 11.

In the case where N (N>=2) radiating elements 121 are electrically connected to each other, following a variation in the configuration of the secondary radiating structure 12, achieved by activating N−1 circuitry elements 15.

In this case, the reactive loads 13 change since the configuration (the length) of the radiating elements 121 varies.

If the reactive loads 14 were not present (and the resonating structures 50 not formed), such a change of the reactive loads 13 (which increases the shorter is the distance between the radiating elements 11 and 121) would be able to vary the overall impedance of the antenna structure 1, when receiving and/or transmitting the electromagnetic radiation.

Instead, when N radiating elements 121 are electrically connected in a selective manner, the primary radiating structure 11 is electrically connected to N circuitry structures 50, which are electrically connected in to each other in parallel, in accordance to the configuration selected for the radiating structure 12 (i.e. depending on how the switching elements 15 have electrically connected the radiating elements 121 one to another).

In particular, the primary radiating structure 11 is electrically connected to N capacitive loads 13, electrically connected in parallel, and to N inductive loads 14, in turn electrically connected in parallel.

The overall reactive load offered by the resonant structures 50 electrically connected in parallel, therefore remains substantially zero, as it is apparent from the relations below.

When all the radiating elements 121 are electrically disconnected from each other, the following relationship applies:

$$\omega = \frac{1}{\sqrt{L_p^{OFF} C_s^{OFF}}}.$$

When N (N>=2) radiating elements 121 are electrically connected to each other, the following relationships apply:

$$\omega = \frac{1}{\sqrt{L_p^{ON} C_s^{ON}}} = \frac{1}{\sqrt{\frac{L_p^{OFF}}{N} N C_s^{OFF}}} = \frac{1}{\sqrt{L_p^{OFF} C_s^{OFF}}},$$

$$L_p^{ON} = \frac{L_p^{OFF}}{N},\ C_s^{ON} = N C_s^{OFF}$$

where $f=2\pi/\omega$ is the operating frequency of the antenna structure 1;

$Cs^{OFF}$ is the value of the reactive loads 13 with all the radiating elements 121 disconnected;

$Lp^{OFF}$ is the value of the reactive loads 14 with all the radiating elements 121 disconnected;

$Cs^{ON}$ is the value of the reactive loads 13 with N radiating elements 121 connected;

$Lp^{ON}$ is the value of the reactive loads 13 with N radiating elements 121 connected.

Therefore, the presence of several radiating elements 121 electrically connected to each other does not result in any variation in the reactive load applied to the primary radiating structure 11.

The same behaviour of the antenna structure 1 occurs when separate groups of electrically connected radiating elements 121 (comprising for example N and M connected radiating elements 121) are simultaneously activated, so as to act as directors or reflectors of the electromagnetic radiation, as required.

Based on the above, it is evident that whatever the radiating mode (or configuration) it operates with, the antenna structure 1 maintains its impedance substantially unchanged, being substantially the same as the characteristic impedance of the primary radiating structure 11.

Figure 9:
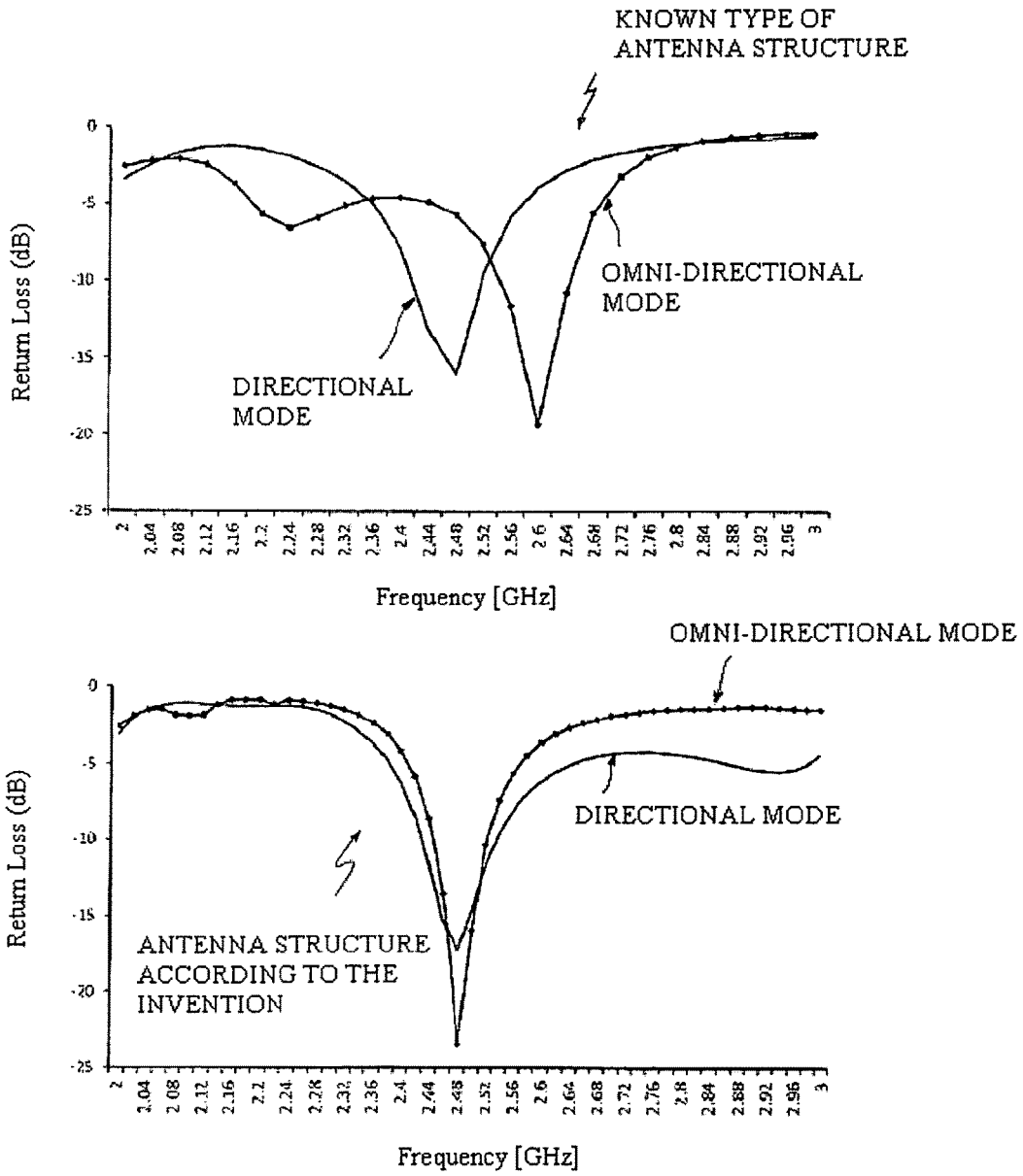

Such a behaviour of the antenna structure 1 is clearly demonstrated by the graphs shown in FIG. 9, which show the so-called "return loss" curves for a known type of antenna structure and for antenna structure 1.

As is known, "return loss" curves indicate an antenna structure's capability to adapt (impedance adaptation) to a communication channel operating on a certain operating frequency band.

It is known how, for a given operating frequency (e.g. 2.48 GHz), the known type of antenna structure is adapted to the communication channel if it operates in a directional mode, but is substantially not adapted if it operates in an omni-directional mode.

This demonstrates how reconfiguration of the antenna structure results in a variation to the overall impedance of the structure.

Conversely, for said operating frequency, the antenna structure 1 is adapted to the communication channel both when operating in directional mode and in omni-directional mode.

This demonstrates how the antenna structure 1 maintains its impedance substantially unchanged, while being able to significantly vary its radiating characteristics.

The antenna structure 1 may be subject to modifications or variants, all of which fall within the scope of the present invention.

For example, according to alternative embodiments of the present invention (not shown), one or more radiating elements 121 could be electrically connected to one or more radiating elements 111 by means of conducting strips, without influencing the behaviour of the antenna structure 1.

Other embodiments of the antenna structure 1 may have circuitry elements 15 consisting of capacitors or variable impedance inductors, each arranged so as to electrically connect/disconnect two radiating elements 121.

Further embodiments of the present invention (not shown) may involve constructing the antenna structure 1 as a "slot" type antenna.

In this case, the radiating structures 11 and 12 could consist of openings made in a support made of electrically conducting material, and the circuitry elements 15 could consist of switching devices electrically connected between two side of the opening defining the radiating structure 12, so as to sub-divide the structure, based on its state of activation, into a multiplicity of electrically connected/disconnected openings, each constituting a radiating element 121.

Also in this case, the antenna structure 1 would comprise inductive reactive loads 13 and capacitive reactive loads 14.

It has been seen in practice how the antenna structure 1, according to the present invention, allows the proposed aim and the objects to be fully achieved.

The antenna structure 1 is able to effectively reconfigure its radiation diagram as required, through the full azimuth angle, without causing variations in its impedance (when receiving and/or transmitting).

The antenna structure 1 can therefore be made with a very compact geometry, preferably of a planar type, including for overall dimensions significantly smaller than the characteristic wavelengths of the operating bandwidth.

For example, with reference to a operating frequency of 2.48 GHz (FIG. 9), the antenna structure can be made with overall dimensions of around $\lambda/4\times\lambda/4$, where $\lambda$ is the wavelength corresponding to the aforementioned operating frequency.

The antenna structure 1 has a layout that is relatively simple to produce using common techniques for producing printed circuits.

Alternatively, the antenna structure 1 could be made using manufacturing techniques typically used for the industrial manufacture of integrated circuits, or using "silicon micromachining" techniques or similar.

The antenna structure 1 is therefore relatively easy and economical to produce industrially.

The antenna structure 1 can be advantageously used for communication purposes in wireless access points, routers, wireless access gateways, microcells, picocells, femtocells, tablets, notebooks, portable communication devices, automotive communication devices, communication interfaces and other electronic devices of similar type.

The invention claimed is:

1. Antenna structure which comprises:

a primary radiating structure comprising one or more first radiating elements;

a secondary radiating structure, operationally associated with said primary radiating structure, said secondary radiating structure comprising a plurality of second radiating elements that can be selectively electrically connected/disconnected to each other to vary the configuration of said secondary radiating structure, so as to vary the radiating properties of said antenna structure;

one or more first reactive loads, electrically connected between said primary and secondary radiating structures;

one or more first circuitry elements adapted to electrically connect/disconnect said second radiating elements in a selective manner in order to vary the configuration of said second radiating structure;

one or more second reactive loads, electrically connected to said secondary radiating structure;

wherein said first reactive loads, said second reactive loads and said second radiating elements forming one or more electrically connected circuits, each of the electrically connected circuits formed by a corresponding first reactive load, second reactive load, and second radiating element, each of the circuits being electrically resonant in the operating frequency band of said antenna structure and electrically connected/disconnected to each other in a selective manner in accordance to the configuration selected for said second radiating structure, thereby maintaining constantly equal to zero the overall reactive load that is electrically connected to said primary radiating structure.

2. Antenna structure according to claim 1, wherein said first and second radiating elements consist of electrically conducting structures.

3. Antenna structure according to claim 2, which comprises one or more first circuitry elements to selectively electrically connect/disconnect said second radiating elements.

4. Antenna structure according to claim 3, wherein said first circuitry elements comprise one or more switching devices and/or variable inductors and/or variable capacitors electrically connected between said second radiating elements.

5. Antenna structure according to claim 3 which comprises a driving circuit comprising one or more bias lines to power said circuitry elements.

6. Antenna structure according to claim 5, wherein said driving circuit comprises second circuitry elements to electrically disconnect said bias lines from each other.

7. Antenna structure according to claim 3, wherein said first reactive loads are electrically connected between said first and second radiating elements and in that said second reactive loads are electrically connected to said second radiating elements.

8. Antenna structure according to claim 3, wherein said first radiating elements and/or said second radiating elements are arranged along a first closed path (A) and/or along a second closed path (B) respectively.

9. Antenna structure according to claim 2, wherein said first and second radiating elements consist, respectively, of first and second conducting tracks, deposited on a first surface of a supporting substrate.

10. Antenna structure according to claim 9, wherein said second inductive reactive loads consist of third conductive tracks, deposited on a second surface of said supporting substrate.

11. Antenna structure according to claim 2, wherein said first reactive loads are electrically connected between said first and second radiating elements and in that said second reactive loads are electrically connected to said second radiating elements.

12. Antenna structure according to claim 2, wherein said first radiating elements and/or said second radiating elements are arranged along a first closed path (A) and/or along a second closed path (B) respectively.

13. Antenna structure according to claim 1, wherein said first reactive loads are electrically connected between said first and second radiating elements and in that said second reactive loads are electrically connected to said second radiating elements.

14. Antenna structure according to claim 13, wherein said first radiating elements and/or said second radiating elements are arranged along a first closed path (A) and/or along a second closed path (B) respectively.

15. Antenna structure according to claim 1, wherein said first radiating elements and/or said second radiating elements are arranged along a first closed path (A) and/or along a second closed path (B) respectively.

16. Antenna structure according to claim 1, wherein said second radiating elements have an electrical length much smaller than the wavelengths of the operating frequencies of said antenna structure.

17. Antenna structure according to claim 1 wherein said first reactive loads-are of a capacitive type and said second reactive loads are of an inductive type.

18. Antenna structure according to claim 5, wherein said driving circuit comprises third circuitry elements to electrically disconnect said bias lines from said second radiating elements.

19. An electronic device which comprises an antenna structure according claim 1.

20. Antenna structure according to claim 1, wherein said second radiating elements have an electrical length smaller than the wavelengths of the operating frequencies of said antenna structure.

* * * * *